United States Patent [19]

Warner et al.

[11] 4,153,861

[45] May 8, 1979

[54] ELECTRIC DISCHARGE TUBE APPARATUS

[76] Inventors: Arthur R. Warner, 11, Portsmouth Rd., Kingston-upon-Thames, Surrey; Derrick A. Ward, 1 High Beech, Croham Manor Rd., South Croydon, Surrey, both of England

[21] Appl. No.: 842,489

[22] Filed: Oct. 17, 1977

[51] Int. Cl.[2] ..... H01J 11/04; H01J 13/48; H01J 15/04; H01J 17/36

[52] U.S. Cl. ..... 315/355; 313/201; 313/220; 313/234

[58] Field of Search ..... 313/201, 220, 234, 515; 315/234, 355, DIG. 1, DIG. 2; 340/334, 335, 337

[56] References Cited

U.S. PATENT DOCUMENTS 3,968,392 7/1976 Buchta et al. ..... 313/201

FOREIGN PATENT DOCUMENTS 650108 2/1951 United Kingdom ..... 315/DIG. 1

*Primary Examiner*—Alfred E. Smith
*Assistant Examiner*—Robert E. Wise
*Attorney, Agent, or Firm*—Christie, Parker & Hale

[57] ABSTRACT

An electric discharge tube in which an electric luminous discharge is to be produced for display purposes has internal electrodes connected to a generator providing an alternating voltage of cyclically varying magnitude. At least one external electrode extending lengthwise of the tube is connected to one generator terminal by way of a reactance, preferably a capacitor. The external electrodes may be wire or thin metal strip and are preferably adhesively secured to the tube envelope. A plurality of such tubes may be connected in series to a single voltage generator.

15 Claims, 4 Drawing Figures

ELECTRIC DISCHARGE TUBE APPARATUS

CROSS-REFERENCE TO RELATED APPLICATION

An oscillator suitable for energizing tubes in accordance with the present invention is described and claimed in a co-pending patent application entitled "Electric Discharge Tube Apparatus" filed concurrently herewith in the names of Arthur Richard Warner and Derrick Arnott Ward.

BACKGROUND OF THE INVENTION

1. Field of the Invention

This invention relates to electric discharge tube apparatus of the kind in which a high frequency voltage of gradually increasing amplitude is applied to a gas discharge tube whereby the luminous discharge is made to extend gradually along the tube from its excited end till it fills the whole length of the tube thereby producing a "writing" effect.

Such discharge is initiated as soon as the intensity of the electric field between the excited electrode and its background reaches a level sufficient to ionise gas in the vicinity of the electrode. The electric field between the gas thus ionised and its background ionises adjoining gas, and as the voltage, and therefore the intensity of the electric field, continues to rise, a luminous discharge column builds up along the tube with a flowing action. The discharge column acts as an extension of the electrode and forms a capacitance with its background, which provides the return path for the discharge current.

If, however, the tube is bent to form the letters of a word or a design, its configuration inevitbly includes sections such as double-backs, loops and the like, where different points on the tube, at some distance from each other along its length, come into close proximity. The discharge does not progress evenly along such sections with a flowing action but rather with a flash-on action, causing the whole section or parts thereof to light up suddenly, thus spoiling the desired writing effect. This erratic behaviour is due to the wide and ill-defined distribution of the electric field in the air space between the discharge columm and its background, whereby it encloses and ionises the gas in the said sections of the tube.

2. Description of the Prior Art

To cure the trouble it is necessary, therefore, to confine the electric field within proper bounds. Means for carrying this into effect are described in United Kingdom Patent No. 1,063,262, and consist of an earthed wire supported and spaced a few millimeters from the surface of the tube along its length. The electric field is thus largely confined to the space within the capacitance formed by the discharge column and the wire. The wire is spaced from the tube because, if it were applied direct to the surface of the tube, (a) the voltage gradient between the discharge column and the wire could be sufficient to induce considerble corona and formation of ozone, or even to puncture the glass wall of the tube, and (b) the discharge current could become unduly large owing to the relatively large capacitance between the discharge column and the earthed wire, resulting in a steep current density gradient along the discharge column, and therefore a marked change in light intensity along its length.

This spaced wire system nevertheless has several shortcomings. Securing the wire to the foamed plastic strip usually employed as the spacing medium, followed by application of the strip along the tube is laborious and time-consuming. Due to its thickness the strip can be unsightly, and is different to accomodate in the narrow gap between the parallel limbs of double-backs in the configuration of the tubing. Also the tube has to be handled with care to avoid damage or dislodgment of the vulnerable strip. Moreover, despite the said spacing, corona and the formation of ozone cannot always be entirely eliminated if the length of tubing operated exceeds 20 feet.

SUMMARY OF THE INVENTION

It is an object of the invention to provide electric discharge tube apparatus in which an external electrode may be applied directly to the external surface of an electric discharge tube.

It is a further object of the invention to provide electric discharge tube apparatus including an external electrode applied to an electric discharge tube and connected to a voltage generator by way of a reactance, whereby the return current of the gas-discharge tube flowing in the reactance raises the voltage of the external electrode, thereby reducing the voltage between the discharge column and the electrode and preventing corona discharge and the formation of ozone in the vicinity of the tube.

It is a specific object of the invention to provide gas-discharge tube apparatus comprising an elongate gas-discharge tube including an elongate tubular envelope containing an inert gas at low pressure, said envelope having at one end thereof an internal electrode that is brought out to a terminal external to the tube, said terminal being connected to one output terminal of a voltage generator developing a progressively varying high-frequency voltage, said gas-discharge tube having associated therewith and extending lengthwise of said envelope an elongate external electrode, in which said external electrode is connected to the other terminal of said voltage generator by way of a reactance.

Typically the reactance may be provided by either a capacitance or inductance, the former being preferred because of its small size and lower cost. Since the voltage applied to the external electrode rises as the length of the discharge column with which it is associated, increases, a limit is set to the length of the electrode or strip which if exceeded, would cause its voltage to rise to a level sufficient to initiate discharge with a flash-on effect in a portion of the tube ahead of the main luminous column or in the vicinity of its second electrode. It is therefore necessary to apply the conductor acting as the external electrode to the tube, or series-connected tubes of an installation, in discrete sections of appropriate length, each with an impedance in its return lead.

The length of the said discrete sections of conductor is not critical and, depending on the circuit conditions, varies from 4 to 8 feet. Wire or metal strip may be used for the external electrodes. Wire is usually preferred where the tube is bent to form small script lettering with numerous double-backs, or along portions of tube more than 20 feet from its earthed internal electrode. In most other cases aluminium foil strip 3 mm wide carrying a pressure-sensitive adhesive on one surface, is preferred, being easily and quickly secured by pressing to the surface of the tube.

DESCRIPTION OF THE PREFERRED EMBODIMENTS

Figure 1:
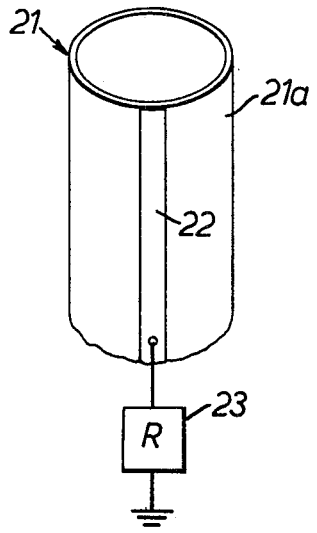
FIGS. 1 and 2 show portions of discharge tubes display device embodying the invention.
Figure 2:
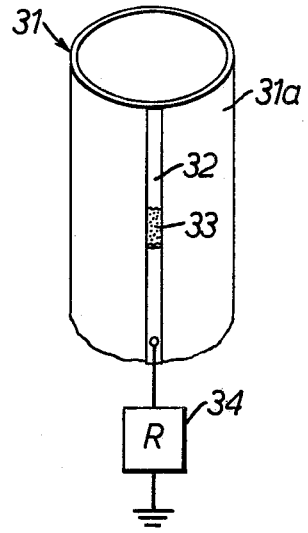

To carry out the invention it is possible to apply a metal strip directly to the glass wall of the discharge tube, for example, by chemical plating or evaporating. Such an arrangement is shown in FIG. 1, where a gas-discharge tube 21 has an electrode 22 applied directly to its glass wall 21*a*. In accordance with the invention the electrode 22 is connected to earth by way of a reactance 23. The application of the electrode to the tube wall in this manner, however, is often inconvenient and/or expensive and it is therefore usually preferred to employ wire or metal strip of the kind described above which can readily be applied to the tube after this has been formed into the desired shape. FIG. 2 shows such an arrangement, in which there is applied to the glass wall 31*a* of the gas-discharge tube 31 a metal strip 32 which forms the electrode and is secured to the tube wall by the pressure-sensitive adhesive 33 carried on one of its surfaces. This strip is advantageously 3 mm wide, because strip of this width is strong enough for easy handling while not providing an excessive capacitance. This electrode is earthed by way of a reactance 34.

It is however possible to employ the invention when using an external electrode spaced from the wall of the discharge tube, if for some reason this is advantageous.

Figure 3:
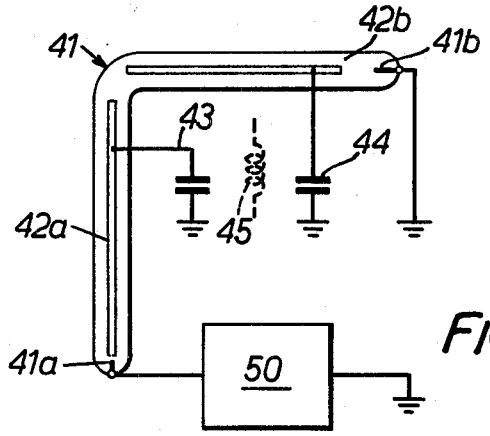
FIGS. 3 and 4 illustrate embodiments of discharge tube display device incorporating the invention.

FIG. 3 shows one embodiment, in which a gas-discharge tube 41, shown by way of example only as being of inverted-L shape, between internal electrodes 41*a*, 41*b* of which a progressively varying voltage is arranged to be applied from a voltage generator 50. It is assumed that tube 41 has a length greater than that which is appropriately provided with a single, reactance-earthed external electrode, and therefore a two-part external electrode is applied, consisting of metal strips 42*a*, 42*b* applied as described in relation to FIG. 1 or 2 to the tube and connected to earth by way of respective reactances, in this case capacitors 43, 44, which are preferably of the low ionisation type. As has been stated, either or each of capacitors 43, 44 may be replaced by an inductor 45 of appropriate reactance, though the greater cost thus involved makes the use of capacitors usually preferable.

Figure 4:
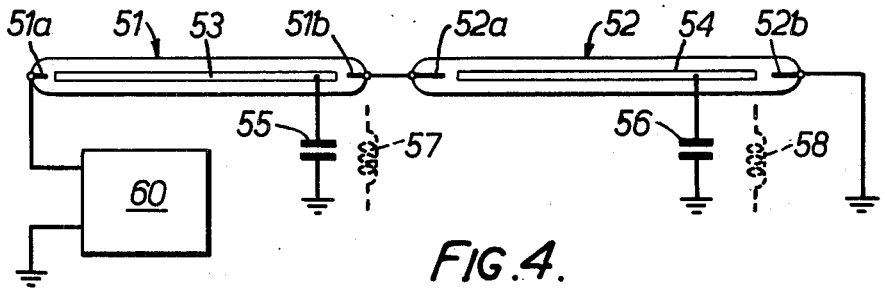

FIG. 4 shows another embodiment of apparatus in accordance with the invention in which two gas-discharge tubes 51, 52 are energised in series from a voltage source 60. Tube 51 has electrodes at each end, of which one, electrode 51*a* is connected to voltage source 60, while the other electrode 51*b* is connected to one internal electrode 52*a* of the second gas-discharge tube 52, the other internal electrode 52*b* of which is earthed. Each of tubes 51, 52 carries an external electrode, 53, 54 respectively which may be applied as described with reference to FIG. 1 or 2. Each of electrodes 53, 54 is connected to earth through a respective reactance, preferably capacitor 55, 56, as shown. As already stated, capacitors 55, 56 may be replaced by inductors 57, 58 of appropriate reactance if preferred.

Since the amplitude of the H.F. voltage at the advancing end of the discharge column remains at a constant low level as the said end progresses along the length of the tube, while that at the stationary end is increasing with the applied voltage, it follows that the difference in current density, and therefore in brightness, at opposite ends of the column, increases with the length of tube operated. This undesirable effect is the more marked if the current density along the column is allowed to increase along a constant gradient, as in the spaced wire system, where a single earthed wire along the length of the tube acts as the external electrode. However, owing to the non-linear response of the eye to changes in light intensity, this effect is not readily perceptible, provided that the length of tube operated is less than about 15 ft., and that the "writing" speed is not unduly slow. But if the said length is exceeded, the effect can become objectionable due to excessive current density along portions of the discharge column adjacent to its stationary end.

The present invention enables the said effect to be minimised (a) by using wire or strip as appropriate for the respective discrete electrodes, (b) by the choice of capacitors of appropriate value for the respective discrete electrodes, and (c) by employing a high-frequency generator the frequency of which decreases significantly fron low load to full load.

Thus in a typical embodiment of the invention comprising 31 ft. of tubing consisting of four neon-filled tubes 11/12 mm diameter, tube 1 6 ft. long, has one external wire electrode 0.015" diameter, with a 100 pfd. capacitor in its earth-return lead, tube 2, 9 ft. long, has one wire electrode 4 ft. long, and one metal strip electrode 3 mm wide, 5 ft. long, each with a 100 pfd capacitor in its return lead, tube 3, 9½ ft. long, has two metal electrodes, each 4½ ft. long and each with a 200 pfd capacitor in its return lead, and tube 4, 7 ft. long has one metal strip electrode 7 ft. long connected to its second internal electrode, which is earthed. The operating frequency of the H.F. generator employed decreases from about 11 kHz when "writing" tube 1 to about 5 kHz when tube 4 has been fully written out.

While tube 1 is being "written" at 11 kHz the reactance of its associated capacitor is correspondingly low, yielding adequate tube current. But at 5 kHz when tube 4 is fully lit, the reactance of the said capacitor is correspondingly high, so that that part of the current in tube 1, flowing via the said capacitor, is correspondingly low. The changing frequency produces similar changes in the current passed by tubes 2, 3 and 4 respectively. This effect, in conjunction with the use of wire followed by strip, and of capacitors of increasing value in the order given above, makes for greater brightness along portions of the column near its advancing end, while preventing an excessive light intensity gradient along the column. When the discharge has extended to the earthed electrode of tube 4, additional current flows which, distinct from the largely capacitive currents flowing during the "writing" action, is in phase with the applied voltage.

The oscillator used, employed a CR timing circuit, and provided an output of which the amplitude was arranged to vary from 200V RMS to 4500V RMS. The said range of operating frequency is far removed from radio broadcast frequencies and, moreover, as the electric field between the discharge column and the external electrode is to a large extent confined to the glass wall of the tube which alone separates them, radio interference from the discharge is confined to the required levels.

In embodiments of the invention difficulties in obtaining a smoothly progressive extension of the luminous discharge along the length of the tube are overcome by providing an associated electrode in very close proximity to the tube wall so that it may follow exactly all convolutions and doublings of tube, and by dividing this electrode into sections each of which is earthed through a respective impedance.

In all embodiments of the invention a gas-discharge tube includes spaced-apart internal electrodes between which a progressively varying high-frequency voltage is applied from an appropriate generator and at least one external electrode connected to the generator through an impedance, preferably a reactive impedance.

What we claim is:

1. A gas-discharge tube apparatus comprising an elongate gas-discharge tube including an elongate tubular envelope containing an inert gas at low pressure, said envelope having at one end thereof an internal electrode that is brought out to a terminal external to the tube, said terminal being connected to one output terminal of a voltage generator arranged to develop a progressively varying high-frequency voltage, said tube having associated therewith and extending lengthwise of said envelope an elongate external electrode connected to the other output terminal of said generator by way of a reactance.

2. The apparatus claimed in claim 1 wherein said external electrode consists of a metal coating applied directly to the outer surface of the wall of said envelope.

3. The apparatus claimed in claim 1 wherein said external electrode consists of a metal strip secured by an adhesive to the outer surface of the envelope.

4. The apparatus claimed in claim 1 wherein said tube has a plurality of external electrodes applied to different portions of the length thereof, ech said external electrode being connected to said generator by way of a respective said reactance.

5. The apparatus claimed in claim 1 wherein said reactance is a capacitor.

6. The apparatus claimed in claim 1 wherein said gas-discharge tube includes a second internal electrode at the end thereof remote from said first internal electrode, said apparatus further comprising another gas-discharge tube having a first internal electrode at one end thereof connected to said second electrode of said first tube, and a second internal electrode at the other end thereof connected to said other output terminal of said generator, said further tube also having applied externally thereof and extending lengthwise of said envelope an elongate electrode connected to said other output terminal of said generator by way of a respective reactance.

7. The invention claimed in claim 6 wherein each said reactance is a capacitor.

8. The invention claimed in claim 1 wherein said gas-discharge tube includes a second internal electrode at the end thereof remote from said first internal electrode, said apparatus further comprising a plurality of further gas-discharge tubes each having a first and a second internal electrode, the first electrode of each said tube being coupled to the second external electrode of a respective preceding said gas-discharge tube and the second electrode of the last in sequence of said further gas-discharge tubes being connected to said other terminal of said generator, each said further gas-discharge tube having associated therewith a said external electrode and each said external electrode being connected to said other terminal of said generator by way of a respective reactance.

9. The apparatus claimed in claim 8 wherein each said reactance is a capacitor.

10. A gas-discharge tube apparatus adapted to be energized by a progressively varying high-frequency voltage defined between first and second supply terminals, the apparatus comprising a gas-discharge tube including a tubular envelope containing an inert gas at low pressure; means for connecting the apparatus to receive said voltage including an external terminal for connection to the first supply terminal and further including an associated internal electrode that at one end of the tube is brought out to said external terminal; a reactance; and at least a portion of the tube being elongated and having associated therewith and extending lengthwise thereof an elongate external electrode connected to the second supply terminal by way of the reactance.

11. The apparatus claimed to claim 10 wherein said external electrode consists of a metal coating applied directly to the outer surface of the wall of said envelope.

12. The apparatus claimed in claim 10 whrein said external electrode consists of a metal strip secured by an adhesive to the outer surface of the envelope.

13. The apparatus claimed in claim 10 wherein said tube has a plurality of elongated portions and a corresponding plurality of external electrodes each applied to a respective elongated portion thereof, each said external electrode being connected to said second source terminal by way of a respective one of a plurality of reactances.

14. The apparatus claimed in claim 10 wherein said reactance is a capacitor.

15. The apparatus claimed in claim 10 wherein said gas-discharge tube includes a second internal electrode at the end thereof remote from said first internal electrode, said apparatus further comprising another reactance and another gas-discharge tube having a first internal electrode at one end thereof connected to said second electrode of said first tube, and a second internal electrode at the other end thereof connected to said other output terminal of said generator, said further tube also having applied externally thereof and extending lengthwise of said envelope an elongate electrode connected to said other output terminal of said generator by way of said another reactance.

* * * * *